US011328645B2

(12) United States Patent
Dai et al.

(10) Patent No.: US 11,328,645 B2
(45) Date of Patent: May 10, 2022

(54) DISPLAY CONTROL METHOD AND DEVICE FOR N-PRIMARY-COLOR DISPLAY PANEL, AND DISPLAY DEVICE

(71) Applicant: BOE TECHNOLOGY GROUP CO., LTD., Beijing (CN)

(72) Inventors: Bin Dai, Beijing (CN); Xue Dong, Beijing (CN); Xiaomang Zhang, Beijing (CN); Jing Lv, Beijing (CN); Dong Chen, Beijing (CN); Yuxin Bi, Beijing (CN); Yanhui Xi, Beijing (CN); Xiaolong Li, Beijing (CN); Haijun Niu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 605 days.

(21) Appl. No.: 16/323,931

(22) PCT Filed: May 31, 2018

(86) PCT No.: PCT/CN2018/089212
§ 371 (c)(1),
(2) Date: Feb. 7, 2019

(87) PCT Pub. No.: WO2019/041928
PCT Pub. Date: Mar. 7, 2019

(65) Prior Publication Data

US 2021/0335183 A1 Oct. 28, 2021

(30) Foreign Application Priority Data

Aug. 28, 2017 (CN) ..... 201710749288.6

(51) Int. Cl.
*G09G 5/02* (2006.01)
*G09G 3/20* (2006.01)

(52) U.S. Cl.
CPC ..... *G09G 3/2003* (2013.01); *G09G 3/2074* (2013.01); *G09G 2300/0443* (2013.01); *G09G 2300/0452* (2013.01); *G09G 2340/06* (2013.01)

(58) Field of Classification Search
CPC ..... G09G 3/2003; G09G 3/2074; G09G 2340/06; G09G 2300/0452; G09G 2300/0443
See application file for complete search history.

(56) References Cited

U.S. PATENT DOCUMENTS

2005/0083352 A1 4/2005 Higgins
2008/0252658 A1 10/2008 Belik et al.
(Continued)

FOREIGN PATENT DOCUMENTS

CN 1558387 A 12/2004
CN 101076848 A 11/2007
(Continued)

OTHER PUBLICATIONS

First Office Action for Chinese Application No. 201710749288.6, dated Apr. 30, 2019, 6 Pages.
(Continued)

*Primary Examiner* — Adam R. Giesy
(74) *Attorney, Agent, or Firm* — Brooks Kushman P.C.

(57) ABSTRACT

The display control method according to some embodiments of the present disclosure includes: acquiring an M-primary-color input signal from each pixel in an original image, the original image including a plurality of pixels corresponding to the plurality of pixel units respectively, each pixel being configured to display a colored image in M primary colors, M being an integer greater than 1 and smaller than N; and calculating an N-primary-color input signal for a corresponding pixel unit of the N-primary-color display panel in
(Continued)

accordance with color coordinates of each primary color for the N-primary-color display panel and the M-primary-color input signal.

18 Claims, 1 Drawing Sheet

(56) References Cited

U.S. PATENT DOCUMENTS

| | | | | |
|---|---|---|---|---|
| 2009/0278862 | A1 | 11/2009 | Shimodaira | |
| 2010/0026728 | A1* | 2/2010 | Miyazaki | G09G 3/36 345/690 |
| 2010/0207965 | A1 | 8/2010 | Belik | |
| 2011/0141159 | A1 | 6/2011 | Takeuchi | |
| 2011/0210911 | A1* | 9/2011 | Nakamura | G09G 3/3655 345/88 |
| 2013/0120472 | A1 | 5/2013 | Byun et al. | |
| 2014/0078197 | A1* | 3/2014 | Park | G09G 3/2003 345/694 |
| 2014/0140616 | A1 | 5/2014 | Choi et al. | |
| 2014/0152687 | A1 | 6/2014 | Liu et al. | |

FOREIGN PATENT DOCUMENTS

| | | | |
|---|---|---|---|
| CN | 101156455 | A | 4/2008 |
| CN | 101779474 | A | 7/2010 |
| CN | 102103820 | A | 6/2011 |
| CN | 103106860 | A | 5/2013 |
| CN | 103686110 | A | 3/2014 |
| CN | 107316602 | A | 11/2017 |
| WO | 2013056387 | A1 | 4/2013 |

OTHER PUBLICATIONS

Second Office Action for Chinese Application No. 201710749288.6, dated Jul. 19, 2019, 8 Pages.

International Search Report and Written Opinion for Application No. PCT/CN2018/089212, dated Aug. 16, 2018, 12 Pages.

Chen, Ting, "Five-Primary LED Display System Implementation Method," Electric Science and Technology, Nov. 30, 2014, vol. 1, Issue 3, 5 pages (including English Abstract).

Ok et al., "Color Processing for Multi-Primary Display Devices," IEEE International Conference on Image Processing 2005, vol. 3, pp. III-980 (4 pages).

* cited by examiner

DISPLAY CONTROL METHOD AND DEVICE FOR N-PRIMARY-COLOR DISPLAY PANEL, AND DISPLAY DEVICE

CROSS-REFERENCE TO RELATED APPLICATION APPLICATIONS

This application is the U.S. national phase of PCT Application No. PCT/CN2018/089212 filed on May 31, 2018, which claims priority to Chinese Patent Application No. 201710749288.6 filed on Aug. 28, 2017, which are incorporated herein by reference in their entireties.

TECHNICAL FIELD

The present disclosure relates to the field of display technology, in particular to a display control method and device for an N-primary-color display panel, and a display device.

BACKGROUND

Display devices have been widely applied to mobile terminals, e.g., mobile phones or laptop computers. In order to achieve a full color mode, usually red (R), green (G) and blue (B) are adopted by the conventional display device as three additive primary colors. Along with the continuous development of the display technology, a resolution and a color expression capability of a display panel are highly demanded. The improvement in the resolution leads to an increase in power consumption and a data transmission volume. In addition, a conventional three-primary-color (RGB) display panel has a limited color expression capability, i.e., it is merely capable of displaying colors within a certain color gamut. In order to reduce the power consumption and the data transmission volume and increase the color expression capability of the display panel, four-primary-color-based, five-primary-color-based or even six-primary-color-based pixel arrangement modes have been proposed.

SUMMARY

In one aspect, the present disclosure provides in some embodiments a display control method for an N-primary-color display panel. The N-primary-color display panel includes a plurality of pixel units, and each pixel unit includes subpixels in N primary colors, where N is an integer greater than or equal to 4. The display control method includes: acquiring an M-primary-color input signal from each pixel in an original image, the original image including a plurality of pixels corresponding to the plurality of pixel units respectively, each pixel being configured to display a colored image in M primary colors, M being an integer greater than 1 and smaller than N; and calculating an N-primary-color input signal for a corresponding pixel unit of the N-primary-color display panel in accordance with color coordinates of each primary color for the N-primary-color display panel and the M-primary-color input signal.

In some possible embodiments of the present disclosure, the calculating the N-primary-color input signal for the corresponding pixel unit of the N-primary-color display panel in accordance with the color coordinates of each primary color for the N-primary-color display panel and the M-primary-color input signal includes: calculating a conversion matrix from the M-primary-color input signal to the N-primary-color input signal in accordance with the color coordinates of each primary color for the N-primary-color display panel and the M-primary-color input signal; and multiplying the M-primary-color input signal with the conversion matrix to acquire the N-primary-color input signal.

In some possible embodiments of the present disclosure, the M primary colors in the M-primary-color input signal include R, G and B.

In some possible embodiments of the present disclosure, the N primary colors in the N-primary-color input signal include the M primary colors, and at least one primary color X other than the M primary colors, and $X_{out}$ in the N-primary-color input signal for the corresponding pixel unit of the N-primary-color display panel acquired in accordance with the M-primary-color input signal for each pixel in the original image is calculated through the following equation: $X_{out}=\partial\tau_{ij}\times j_{in}+(1-\partial)\tau_{ij}\times i_{in}$, where at least one coordinate value of color coordinates of the primary color X in one direction is located between corresponding coordinate values of color coordinates of primary colors i, j in a chromacity diagram, a primary color k is a primary color other than the primary colors i, j in the primary colors R, G and B, $X_{out}$ represents an input signal for the primary color X of the corresponding pixel unit of the N-primary-color display panel, $$\partial = \frac{L_{xi}}{L_{xi} + L_{xj}},$$

$$\tau_{ij} = \frac{\min(i_{in}, j_{in})}{\max(i_{in}, j_{in})},$$

$\min(i_{in},j_{in})$ represents a minimum value of grayscale values for i and j in the M-primary-color input signal, $\max(i_{in},j_{in})$ represents a maximum value of the grayscale values for i and j in the M-primary-color input signal, $L_{xi}$ represents a distance between a position corresponding to the color coordinates of x and a position corresponding to the color coordinates of i in the chromacity diagram, and $L_{xj}$ represents a distance between the position corresponding to the color coordinates of x and a position corresponding to the color coordinates of j in the chromacity diagram.

In some possible embodiments of the present disclosure, each pixel unit of the N-primary-color display panel includes an R subpixel, a G subpixel, a B subpixel, a cyan (C) subpixel and a yellow (Y) subpixel, and each pixel in the original image is configured to display the colored image in R, G and B.

In some possible embodiments of the present disclosure, the calculating the conversion matrix from the M-primary-color input signal to the N-primary-color input signal in accordance with the color coordinates of each primary color for the N-primary-color display panel and the M-primary-color input signal includes calculating the conversion matrix T from a three-primary-color input signal for each pixel in the original image to a five-primary-color input signal for the corresponding pixel unit of the N-primary-color display panel through the following equation:

$$T = \begin{bmatrix} 1 & 0 & 0 \\ 0 & 1 & 0 \\ 0 & 0 & 1 \\ \partial\tau_{GR} & (1-\partial)\tau_{GR} & 0 \\ 0 & (1-\beta)\tau_{GB} & \beta\tau_{GB} \end{bmatrix},$$

-continued where $$\partial = \frac{L_{YG}}{L_{YG} + L_{YR}},$$

$$\beta = \frac{L_{CG}}{L_{CG} + L_{CB}},$$

$$\tau_{GR} = \frac{\min(G_{in}, B_{in})}{\max(G_{in}, B_{in})},$$

$$\tau_{GB} = \frac{\min(G_{in}, B_{in})}{\max(G_{in}, B_{in})},$$

$\min(G_{in},R_{in})$ represents a minimum value of grayscale values of G and R in the three-primary-color input signal, $\max(G_{in},R_{in})$ represents a maximum value of the grayscale values of G and R in the three-primary-color input signal, $\min(G_{in},B_{in})$ represents a minimum value of grayscale values of G and B in the three-primary-color input signal, $\max(G_{in},B_{in})$ represents a maximum value of the grayscale values of G and B in the three-primary-color input signal, $L_{YR}$ represents a distance between a position corresponding to color coordinates of Y and a position corresponding to color coordinates of R in the chromacity diagram, $L_{YG}$ represents a distance between the position corresponding to the color coordinates of Y and a position corresponding to color coordinates of G in the chromacity diagram, $L_{CG}$ represents a distance between a position corresponding to color coordinates of C and the position corresponding to the color coordinates of G in the chromacity diagram, and $L_{CB}$ represents a distance between the position corresponding to the color coordinates of C and a position corresponding to color coordinates of B in the chromacity diagram.

In some possible embodiments of the present disclosure, each pixel unit of the N-primary-color display panel includes an R subpixel, a G subpixel, a B subpixel, a C subpixel, a Y subpixel, and a magenta (M) subpixel, and each pixel in the original image is configured to display the colored image in R, G and B.

In some possible embodiments of the present disclosure, the calculating the conversion matrix from the M-primary-color input signal to the N-primary-color input signal in accordance with the color coordinates of each primary color for the N-primary-color display panel and the M-primary-color input signal includes calculating the conversion matrix T from a three-primary-color input signal for each pixel in the original image to a six-primary-color input signal for the corresponding pixel unit of the N-primary-color display panel through the following equation:

$$T = \begin{bmatrix} 1 & 0 & 0 \\ 0 & 1 & 0 \\ 0 & 0 & 1 \\ \partial\tau_{GR} & (1-\partial)\tau_{GR} & 0 \\ 0 & (1-\beta)\tau_{GB} & \beta\tau_{GB} \\ (1-\gamma)\tau_{RB} & 0 & \gamma_{RB}^{\tau} \end{bmatrix},$$

where $$\partial = \frac{L_{YG}}{L_{YG} + L_{YR}},$$

$$\beta = \frac{L_{CG}}{L_{CG} + L_{CB}},$$

$$\gamma = \frac{L_{MR}}{L_{MB} + L_{MR}},$$

-continued $$\tau_{GR} = \frac{\min(G_{in}, R_{in})}{\max(G_{in}, R_{in})},$$

$$\tau_{GB} = \frac{\min(G_{in}, B_{in})}{\max(G_{in}, B_{in})},$$

$$\tau_{RB} = \frac{\min(R_{in}, B_{in})}{\max(R_{in}, B_{in})},$$

$\min(G_{in},R_{in})$ represents a minimum value of grayscale values of G and R in the three-primary-color input signal, $\max(G_{in},R_{in})$ represents a maximum value of the grayscale values of G and R in the three-primary-color input signal, $\min(G_{in},B_{in})$ represents a minimum value of grayscale values of G and B in the three-primary-color input signal, $\max(G_{in},B_{in})$ represents a maximum value of the grayscale values of G and B in the three-primary-color input signal $\min(G_{in},B_{in})$ represents a minimum value of grayscale values of R and B in the three-primary-color input signal $\max(G_{in},B_{in})$ represents a maximum value of the grayscale values of R and B in the three-primary-color input signal, $L_{YR}$ represents a distance between a position corresponding to color coordinates of Y and a position corresponding to color coordinates of R in the chromacity diagram, $L_{YG}$ represents a distance between the position corresponding to the color coordinates of Y and a position corresponding to color coordinates of G in the chromacity diagram, $L_{CG}$ represents a distance between a position corresponding to color coordinates of C and the position corresponding to the color coordinates of G in the chromacity diagram, $L_{CB}$ represents a distance between the position corresponding to the color coordinates of C and a position corresponding to color coordinates of B in the chromacity diagram, $L_{MR}$ represents a distance between a position corresponding to color coordinates of M and the position corresponding to the color coordinates of R in the chromacity diagram, and $L_{MB}$ represents a distance between the position corresponding to the color coordinates of M and the position corresponding to the color coordinates of B in the chromacity diagram.

In some possible embodiments of the present disclosure, prior to the calculating the N-primary-color input signal for the corresponding pixel unit of the N-primary-color display panel in accordance with the color coordinates of each primary color for the N-primary-color display panel and the M-primary-color input signal, the display control method further includes testing the N-primary-color display panel to acquire the color coordinates of each primary color for the N-primary-color display panel.

In some possible embodiments of the present disclosure, subsequent to the calculating the N-primary-color input signal for the corresponding pixel unit of the N-primary-color display panel in accordance with the color coordinates of each primary color for the N-primary-color display panel and the M-primary-color input signal, the display control method further includes processing the N-primary-color input signal through a pixel rendering algorithm to acquire an N-primary-color driving signal, and inputting the N-primary-color driving signal to the N-primary-color display panel.

In another aspect, the present disclosure provides in some embodiments a display control device for an N-primary-color display panel. The display control device is implemented by a computer, and includes a processor, a memory, and a computer program stored in the memory and executed by the processor so as to implement a display control method for the N-primary-color display panel. The N-primary-color display panel includes a plurality of pixel units, and each pixel unit includes subpixels in N primary colors, where N is an integer greater than or equal to 4. The processor is configured to execute the computer program, and configured to: acquire an M-primary-color input signal from each pixel in an original image, the original image including a plurality of pixels corresponding to the plurality of pixel units respectively, each pixel being configured to display a colored image in M primary colors, M being an integer greater than 1 and smaller than N; and calculate an N-primary-color input signal for a corresponding pixel unit of the N-primary-color display panel in accordance with color coordinates of each primary color for the N-primary-color display panel and the M-primary-color input signal.

In some possible embodiments of the present disclosure, the processor is further configured to execute the computer program, and configured to: calculate a conversion matrix from the M-primary-color input signal to the N-primary-color input signal in accordance with the color coordinates of each primary color for the N-primary-color display panel and the M-primary-color input signal; and multiply the M-primary-color input signal with the conversion matrix to acquire the N-primary-color input signal.

In some possible embodiments of the present disclosure, the M primary colors in the M-primary-color input signal include R, G and B.

In some possible embodiments of the present disclosure, the N primary colors in the N-primary-color input signal include the M primary colors, and at least one primary color X other than the M primary colors, and $X_{out}$ in the N-primary-color input signal for the corresponding pixel unit of the N-primary-color display panel acquired in accordance with the M-primary-color input signal for each pixel in the original image is calculated through the following equation: $X_{out}=\partial\tau_{ij}\times j_{in}+(1-\partial)\tau_{ij}\times i_{in}$, where at least one coordinate value of color coordinates of the primary color X in one direction is located between corresponding coordinate values of color coordinates of primary colors i, j in a chromacity diagram, a primary color k is a primary color other than the primary colors i, j in the primary colors R, G and B, $X_{out}$ represents an input signal for the primary color X of the corresponding pixel unit of the N-primary-color display panel, $$\partial = \frac{L_{xi}}{L_{xi} + L_{xj}},$$

$$\tau_{ij} = \frac{\min(i_{in}, j_{in})}{\max(i_{in}, j_{in})},$$

$\min(i_{in},j_{in})$ represents a minimum value of grayscale values for i and j in the M-primary-color input signal, $\max(i_{in},j_{in})$ represents a maximum value of the grayscale values for i and j in the M-primary-color input signal, $L_{xi}$ represents a distance between a position corresponding to the color coordinates of x and a position corresponding to the color coordinates of i in the chromacity diagram, and $L_{xj}$ represents a distance between the position corresponding to the color coordinates of x and a position corresponding to the color coordinates of j in the chromacity diagram.

In some possible embodiments of the present disclosure, each pixel unit of the N-primary-color display panel includes an R subpixel, a G subpixel, a B subpixel, a C subpixel and a Y subpixel, and each pixel in the original image is configured to display the colored image in R, G and B.

In some possible embodiments of the present disclosure, the processor is further configured to execute the computer program, so as to calculate the conversion matrix T from a three-primary-color input signal for each pixel in the original image to a five-primary-color input signal for the corresponding pixel unit of the N-primary-color display panel through the following equation:

$$T = \begin{bmatrix} 1 & 0 & 0 \\ 0 & 1 & 0 \\ 0 & 0 & 1 \\ \partial\tau_{GR} & (1-\partial)\tau_{GR} & 0 \\ 0 & (1-\beta)\tau_{GB} & \beta\tau_{GB} \end{bmatrix},$$

where $$\partial = \frac{L_{YG}}{L_{YG} + L_{YR}},$$

$$\beta = \frac{L_{CG}}{L_{CG} + L_{CB}},$$

$$\tau_{GR} = \frac{\min(G_{in}, B_{in})}{\max(G_{in}, B_{in})},$$

$$\tau_{GB} = \frac{\min(G_{in}, B_{in})}{\max(G_{in}, B_{in})},$$

$\min(G_{in},R_{in})$ represents a minimum value of grayscale values of G and R in the three-primary-color input signal, $\max(G_{in},R_{in})$ represents a maximum value of the grayscale values of G and R in the three-primary-color input signal, $\min(G_{in},B_{in})$ represents a minimum value of grayscale values of G and B in the three-primary-color input signal, $\max(G_{in},B_{in})$ represents a maximum value of the grayscale values of G and B in the three-primary-color input signal, $L_{YR}$ represents a distance between a position corresponding to color coordinates of Y and a position corresponding to color coordinates of R in the chromacity diagram, $L_{YG}$ represents a distance between the position corresponding to the color coordinates of Y and a position corresponding to color coordinates of G in the chromacity diagram, $L_{CG}$ represents a distance between a position corresponding to color coordinates of C and the position corresponding to the color coordinates of G in the chromacity diagram, and $L_{CB}$ represents a distance between the position corresponding to the color coordinates of C and a position corresponding to color coordinates of B in the chromacity diagram.

In some possible embodiments of the present disclosure, each pixel unit of the N-primary-color display panel includes an R subpixel, a G subpixel, a B subpixel, a C subpixel, a Y subpixel, and an M subpixel, and each pixel in the original image is configured to display the colored image in R, G and B.

In some possible embodiments of the present disclosure, the processor is further configured to execute the computer program, and configured to calculate the conversion matrix T from a three-primary-color input signal for each pixel in the original image to a six-primary-color input signal for the corresponding pixel unit of the N-primary-color display panel through the following equation:

$$T = \begin{bmatrix} 1 & 0 & 0 \\ 0 & 1 & 0 \\ 0 & 0 & 1 \\ \partial\tau_{GR} & (1-\partial)\tau_{GR} & 0 \\ 0 & (1-\beta)\tau_{GB} & \beta\tau_{GB} \\ (1-\gamma)\tau_{RB} & 0 & \gamma_{RB}^{\tau} \end{bmatrix},$$

where $$\partial = \frac{L_{YG}}{L_{YG} + L_{YR}},$$

$$\beta = \frac{L_{CG}}{L_{CG} + L_{CB}},$$

$$\gamma = \frac{L_{MR}}{L_{MB} + L_{MR}},$$

$$\tau_{GR} = \frac{\min(G_{in}, R_{in})}{\max(G_{in}, R_{in})},$$

$$\tau_{GB} = \frac{\min(G_{in}, B_{in})}{\max(G_{in}, B_{in})},$$

$$\tau_{RB} = \frac{\min(R_{in}, B_{in})}{\max(R_{in}, B_{in})},$$

$\min(G_{in},R_{in})$ represents a minimum value of grayscale values of G and R in the three-primary-color input signal, $\max(G_{in},R_{in})$ represents a maximum value of the grayscale values of G and R in the three-primary-color input signal, $\min(G_{in},B_{in})$ represents a minimum value of grayscale values of G and B in the three-primary-color input signal, $\max(G_{in},B_{in})$ represents a maximum value of the grayscale values of G and B in the three-primary-color input signal, $\min(G_{in},B_{in})$ represents a minimum value of grayscale values of R and B in the three-primary-color input signal $\max(G_{in},B_{in})$ represents a maximum value of the grayscale values of R and B in the three-primary-color input signal, $L_{YR}$ represents a distance between a position corresponding to color coordinates of Y and a position corresponding to color coordinates of R in the chromacity diagram, $L_{YG}$ represents a distance between the position corresponding to the color coordinates of Y and a position corresponding to color coordinates of G in the chromacity diagram, $L_{CG}$ represents a distance between a position corresponding to color coordinates of C and the position corresponding to the color coordinates of G in the chromacity diagram, $L_{CB}$ represents a distance between the position corresponding to the color coordinates of C and a position corresponding to color coordinates of B in the chromacity diagram, $L_{MR}$ represents a distance between a position corresponding to color coordinates of M and the position corresponding to the color coordinates of R in the chromacity diagram, and $L_{MB}$ represents a distance between the position corresponding to the color coordinates of M and the position corresponding to the color coordinates of B in the chromacity diagram.

In some possible embodiments of the present disclosure, the processor is further configured to execute the computer program, and configured to test the N-primary-color display panel to acquire the color coordinates of each primary color for the N-primary-color display panel.

In some possible embodiments of the present disclosure, the processor is further configured to execute the computer program, and configured to process the N-primary-color input signal through a pixel rendering algorithm to acquire an N-primary-color driving signal, and to input the N-primary-color driving signal to the N-primary-color display panel.

In yet another aspect, the present disclosure provides in some embodiments a display device including an N-primary-color display panel and the above-mentioned display control device.

In still yet another aspect, the present disclosure provides in some embodiments a computer-readable storage medium storing therein computer programs which are executed by a processor so as to implement the above-mentioned display control method.

BRIEF DESCRIPTION OF THE DRAWINGS

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort.

DETAILED DESCRIPTION

In order to make the objects, the technical solutions and the advantages of the present disclosure more apparent, the present disclosure will be described hereinafter in a clear and complete manner in conjunction with the drawings and embodiments.

In the related art, there is no perfect scheme for acquiring a four-primary-color, five-primary-color or even six-primary-color input signal in accordance with a three-primary-color input signal. An object of the present disclosure is to provide a display control method and a display control device for an N-primary-color display panel, and a display device, to acquire the four-primary-color, five-primary-color or even six-primary-color input signal in accordance with the three-primary-color input signal.

Figure 1:
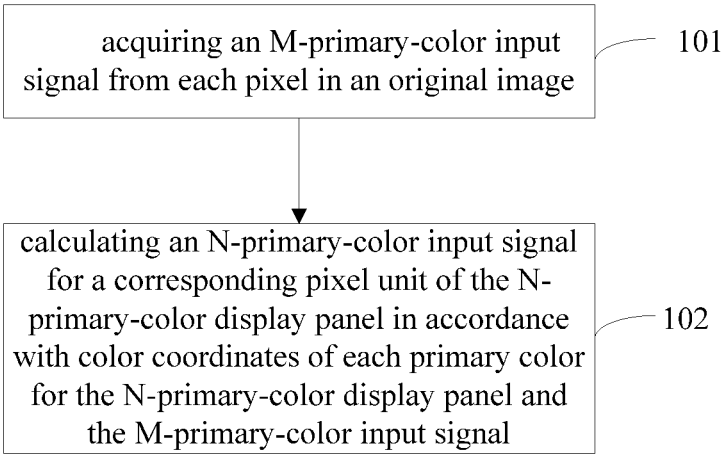
FIG. 1 is a flow chart of a display control method for an N-primary-color display panel according to some embodiments of the present disclosure.

The present disclosure provides in some embodiments a display control method for an N-primary-color display panel. The N-primary-color display panel includes a plurality of pixel units, and each pixel unit includes subpixels in N primary colors, where N is an integer greater than or equal to 4. As shown in FIG. 1, the display control method includes: Step 101 of acquiring an M-primary-color input signal from each pixel in an original image, the original image including a plurality of pixels corresponding to the plurality of pixel units respectively, each pixel being configured to display a colored image in M primary colors, M being an integer greater than 1 and smaller than N; and Step 102 of calculating an N-primary-color input signal for a corresponding pixel unit of the N-primary-color display panel in accordance with color coordinates of each primary color for the N-primary-color display panel and the M-primary-color input signal.

According to the embodiments of the present disclosure, the M-primary-color input signal for each pixel in the original image may be acquired, and then the N-primary-color input signal for the corresponding pixel unit of the N-primary-color display panel may be calculated in accordance with the color coordinates of each primary color for the N-primary-color display panel and the M-primary-color input signal, to acquire the four-primary-color, five-primary-color or even six-primary-color input signal in accordance with the three-primary-color input signal. In addition, as compared with a conventional three-primary-color display panel, it is able for the N-primary-color display panel in the embodiments of the present disclosure to display an image in more primary colors, thereby to improve a color gamut of the image as well as a display effect.

Color coordinates of each primary color for the N-primary-color display panel depends on a material adopted by the N-primary-color display panel, and the color coordinates of the primary colors for different N-primary-color display panels may be different from each other. Hence, at first, it is necessary to test the N-primary-color display panel, to acquire the color coordinates of each primary color for the N-primary-color display panel. In some possible embodiments of the present disclosure, prior to calculating the N-primary-color input signal for the corresponding pixel unit of the N-primary-color display panel in accordance with the color coordinates of each primary color for the N-primary-color display panel and the M-primary-color input signal, the display control method may further include testing the N-primary-color display panel to acquire the color coordinates of each primary color for the N-primary-color display panel. Optical testing instrument, e.g., a color analyzer, may be adopted to test the N-primary-color display panel to acquire the color coordinates of each primary color. To be specific, a probe of the color analyzer may be laid on the N-primary-color display panel, and after a measured value is in a stable state, it is able to acquire the color coordinates of each primary color for the N-primary-color display panel.

In some possible embodiments of the present disclosure, the calculating the N-primary-color input signal for the corresponding pixel unit of the N-primary-color display panel in accordance with the color coordinates of each primary color for the N-primary-color display panel and the M-primary-color input signal may include: calculating a conversion matrix from the M-primary-color input signal to the N-primary-color input signal in accordance with the color coordinates of each primary color for the N-primary-color display panel and the M-primary-color input signal; and multiplying the M-primary-color input signal with the conversion matrix to acquire the N-primary-color input signal.

The conversion matrix from the three-primary-color input signal to the N-primary-color input signal may be calculated in accordance with the color coordinates of each primary color for the N-primary-color display panel, and upon the receipt of the three-primary-color input signal, the N-primary-color input signal may be acquired through multiplying the three-primary-color input signal with the conversion matrix. In this way, it is able to acquire the four-primary-color, five-primary-color or even the six-primary-color input signal in accordance with the three-primary-color input signal.

In some possible embodiments of the present disclosure, the M primary colors in the M-primary-color input signal may include R, G and B.

In some possible embodiments of the present disclosure, the N primary colors in the N-primary-color input signal include the M primary colors, and at least one primary color X other than the M primary colors, and $X_{out}$ in the N-primary-color input signal for the corresponding pixel unit of the N-primary-color display panel acquired in accordance with the M-primary-color input signal for each pixel in the original image is calculated through the following equation: $X_{out}=\partial\tau_{ij}\times j_{in}+(1-\partial)\tau_{ij}\times i_{in}$ (1). Here, at least one coordinate value of color coordinates of the primary color X in one direction is located between corresponding coordinate values of color coordinates of primary colors i, j in a chromacity diagram, a primary color k is a primary color other than the primary colors i, j in the primary colors R, G and B, $X_{out}$ represents an input signal for the primary color X of the corresponding pixel unit of the N-primary-color display panel, $$\partial = \frac{L_{xi}}{L_{xi} + L_{xj}}, \tag{2}$$

$$\tau_{ij} = \frac{\min(i_{in}, j_{in})}{\max(i_{in}, j_{in})}, \tag{3}$$

$\min(i_{in},j_{in})$ represents a minimum value of grayscale values for i and j in the M-primary-color input signal, $\max(i_{in},j_{in})$ represents a maximum value of the grayscale values for i and j in the M-primary-color input signal, $L_{xi}$ represents a distance between a position corresponding to the color coordinates of x and a position corresponding to the color coordinates of i in the chromacity diagram, and $L_{xj}$ represents a distance between the position corresponding to the color coordinates of x and a position corresponding to the color coordinates of j in the chromacity diagram.

The conversion matrix from the three-primary-color input signal to the N-primary-color input signal may be calculated in accordance with the color coordinates of each primary color for the N-primary-color display panel, and upon the receipt of the three-primary-color input signal, the N-primary-color input signal may be acquired through multiplying the three-primary-color input signal with the conversion matrix. In this way, it is able to acquire the four-primary-color, five-primary-color or even the six-primary-color input signal in accordance with the three-primary-color input signal.

In another possible embodiment of the present disclosure, the N-primary-color display panel may be a five-primary-color display panel, and through the scheme in the embodiments of the present disclosure, it is able to acquire the five-primary-color input signal in accordance with the three-primary-color input signal. To be specific, each pixel unit of the N-primary-color display panel may include an R subpixel, a G subpixel, a B subpixel, a C subpixel and a Y subpixel, and each pixel in the original image may be configured to display the colored image in R, G and B, i.e., the input signal may be an RBG input signal.

The conversion matrix T from a three-primary-color input signal for each pixel in the original image to a five-primary-color input signal for the corresponding pixel unit of the N-primary-color display panel may be calculated in accordance with the color coordinates of each primary color in the chromacity diagram. When the three-primary-color input signal is to be converted into the five-primary-color input signal, the following conditions need to be met: (1) when a pixel corresponding to the three-primary-color input signal is white (W), color coordinates of a position corresponding to a W point in the chromacity diagram remain unchanged after the conversion; (2) when a pixel corresponding to the three-primary-color input signal is colorless, color coordinates of a position corresponding to a colorless point in the chromacity diagram remain unchanged after the conversion; and (3) when a pixel corresponding to the three-primary-color input signal is R, G or B, color coordinates of a position corresponding to the R, G or B point in the chromacity diagram remain unchanged after the conversion. In other words, the following equation needs to be met:

$$\begin{cases} R_{out} = R_{in} \\ G_{out} = G_{in} \\ B_{out} = B_{in} \\ Y_{out} = [(1-\partial)G_{in} + \partial R_{in}] * \dfrac{\min(G_{in}, R_{in})}{\max(G_{in}, R_{in})} \\ C_{out} = [(1-\beta)G_{in} + \beta B_{in}] * \dfrac{\min(G_{in}, B_{in})}{\max(G_{in}, B_{in})} \end{cases}, \tag{4}$$

where $$\partial = \frac{L_{YG}}{L_{YG} + L_{YR}},\ \beta = \frac{L_{CG}}{L_{CG} + L_{CB}},$$

$L_{YR}$ represents a distance between a position corresponding to color coordinates of Y and a position corresponding to color coordinates of R in the chromacity diagram, $L_{YG}$ represents a distance between the position corresponding to the color coordinates of Y and a position corresponding to color coordinates of G in the chromacity diagram, $L_{CG}$ represents a distance between a position corresponding to color coordinates of C and the position corresponding to the color coordinates of G in the chromacity diagram, and $L_{CB}$ represents a distance between the position corresponding to the color coordinates of C and a position corresponding to color coordinates of B in the chromacity diagram.

$$\tau_{GR} = \frac{\min(G_{in}, B_{in})}{\max(G_{in}, B_{in})} \tag{5}$$

and $$\tau_{GB} = \frac{\min(G_{in}, B_{in})}{\max(G_{in}, B_{in})},$$

where $\min(G_{in},R_{in})$ represents a minimum value of grayscale values of G and R in the three-primary-color input signal, $\max(G_{in},R_{in})$ represents a maximum value of the grayscale values of G and R in the three-primary-color input signal, $\min(G_{in},B_{in})$ represents a minimum value of grayscale values of G and B in the three-primary-color input signal, and $\max(G_{in},B_{in})$ represents a maximum value of the grayscale values of G and B in the three-primary-color input signal.

Next, equation (5) may be substituted into equation (4), so as to acquire the following equation:

$$\begin{cases} R_{out} = R_{in} \\ G_{out} = G_{in} \\ B_{out} = B_{in} \\ Y_{out} = [(1-\partial)G_{in} + \partial R_{in}] * \tau_{GR} \\ C_{out} = [(1-\beta)G_{in} + \beta B_{in}] * \tau_{GB} \end{cases}. \tag{6}$$

Next, based on equation (6), the following equation may be acquired:

$$\begin{bmatrix} R_{out} \\ G_{out} \\ B_{out} \\ Y_{out} \\ C_{out} \end{bmatrix} = \begin{bmatrix} 1 & 0 & 0 \\ 0 & 1 & 0 \\ 0 & 0 & 1 \\ \partial\tau_{GR} & (1-\partial)\tau_{GR} & 0 \\ 0 & (1-\beta)\tau_{GB} & \beta\tau_{GB} \end{bmatrix} \begin{bmatrix} R_{in} \\ G_{in} \\ B_{in} \end{bmatrix}. \tag{7}$$

The conversion matrix T from the three-primary-color input signal for each pixel in the original image to the five-primary-color input signal for the corresponding pixel unit of the N-primary-color display panel may be acquired through equation (4), i.e., $$T = \begin{bmatrix} 1 & 0 & 0 \\ 0 & 1 & 0 \\ 0 & 0 & 1 \\ \partial\tau_{GR} & (1-\partial)\tau_{GR} & 0 \\ 0 & (1-\beta)\tau_{GB} & \beta\tau_{GB} \end{bmatrix},$$

where $$Y = \begin{bmatrix} R_{out} \\ G_{out} \\ B_{out} \\ Y_{out} \\ C_{out} \end{bmatrix}$$

represents the five-primary-color input signal, and $$X = \begin{bmatrix} R_{in} \\ G_{in} \\ B_{in} \end{bmatrix}$$

represents the three-primary-color input signal.

In addition, equation (7) may also be rewritten as Y=TX (8), and through equation (8), it is able to convert the three-primary-color input signal for each pixel in the original image to the five-primary-color input signal for the corresponding pixel unit of the N-primary-color display panel.

In some possible embodiments of the present disclosure, the N-primary-color display panel may be a six-primary-color display panel, and through the scheme in the embodiments of the present disclosure, it is able to acquire a six-primary-color input signal in accordance with the three-primary-color input signal. To be specific, each pixel unit of the N-primary-color display panel may include an R subpixel, a G subpixel, a B subpixel, a C subpixel, a Y subpixel, and an M subpixel, and each pixel in the original image may be configured to display the colored image in R, G and B.

The conversion matrix T from the three-primary-color input signal for each pixel in the original image to the six-primary-color input signal for the corresponding pixel unit of the N-primary-color display panel may be calculated in accordance with the color coordinates of each primary color in the chromacity diagram. When the three-primary-color input signal is to be converted into the six-primary-color input signal, the following conditions need to be met: (1) when a pixel corresponding to the three-primary-color input signal is white (W), color coordinates of a position corresponding to a W point in the chromacity diagram remain unchanged after the conversion; (2) when a pixel corresponding to the three-primary-color input signal is colorless, color coordinates of a position corresponding to a colorless point in the chromacity diagram remain unchanged after the conversion; and (3) when a pixel corresponding to the three-primary-color input signal is R, G or B, color coordinates of a position corresponding to the R, G or B point in the chromacity diagram remain unchanged after the conversion. In other words, the following equation needs to be met:

$$\begin{cases} R_{out} = R_{in} \\ G_{out} = G_{in} \\ B_{out} = B_{in} \\ Y_{out} = [(1-\partial)G_{in} + \partial R_n] * \dfrac{\min(G_{in}, R_{in})}{\max(G_{in}, R_{in})}, \\ C_{out} = [(1-\beta)G_{in} + \beta B_{in}] * \dfrac{\min(G_{in}, B_{in})}{\max(G_{in}, B_w)} \\ M_{out} = [(1-\gamma)R_{in} + \gamma B_{in}] * \dfrac{\min(R_{in}, B_{in})}{\max(R_{in}, B_{in})} \end{cases} \tag{9}$$

$$\text{where } \partial = \frac{L_{YG}}{L_{YG} + L_{YR}},\ \beta = \frac{L_{CG}}{L_{CG} + L_{CB}},\ \gamma = \frac{L_{MR}}{L_{MB} + L_{MR}},$$

$L_{YR}$ represents a distance between a position corresponding to color coordinates of Y and a position corresponding to color coordinates of R in the chromacity diagram, $L_{YG}$ represents a distance between the position corresponding to the color coordinates of Y and a position corresponding to color coordinates of G in the chromacity diagram, $L_{CG}$ represents a distance between a position corresponding to color coordinates of C and the position corresponding to the color coordinates of G in the chromacity diagram, $L_{CB}$ represents a distance between the position corresponding to the color coordinates of C and a position corresponding to color coordinates of B in the chromacity diagram, $L_{MR}$ represents a distance between a position corresponding to color coordinates of M and the position corresponding to the color coordinates of R in the chromacity diagram, and $L_{MB}$ represents a distance between the position corresponding to the color coordinates of M and the position corresponding to the color coordinates of B in the chromacity diagram.

$$\tau_{GR} = \frac{\min(G_{in}, R_{in})}{\max(G_{in}, R_{in})}, \tag{10}$$

$$\tau_{GB} = \frac{\min(G_{in}, B_{in})}{\max(G_{in}, B_{in})} \text{ and } \tau_{RB} = \frac{\min(R_{in}, B_{in})}{\max(R_{in}, B_{in})},$$

where $\min(G_{in},R_{in})$ represents a minimum value of grayscale values of G and R in the three-primary-color input signal, $\max(G_{in},R_{in})$ represents a maximum value of the grayscale values of G and R in the three-primary-color input signal, $\min(G_{in},B_{in})$ represents a minimum value of grayscale values of G and B in the three-primary-color input signal, $\max(G_{in},B_{in})$ represents a maximum value of the grayscale values of G and B in the three-primary-color input signal, $\min(G_{in},B_{in})$ represents a minimum value of grayscale values of R and B in the three-primary-color input signal, and $\max(G_{in},B_{in})$ represents a maximum value of the grayscale values of R and B in the three-primary-color input signal.

Next, equation (10) may be substituted into equation (9), so as to acquire the following equation:

$$\begin{cases} R_{out} = R_{in} \\ G_{out} = G_{in} \\ B_{out} = B_{in} \\ Y_{out} = [(1-\partial)G_{in} + \partial R_{in}] * \tau_{GR} \\ C_{out} = [(1-\beta)G_{in} + \beta B_{in}] * \tau_{GR} \\ M_{out} = [(1-\gamma)R_{in} + \gamma B_{in}] * \tau_{GR} \end{cases}. \tag{11}$$

Next, based on equation (11), the following equation may be acquired:

$$\begin{bmatrix} R_{out} \\ G_{out} \\ B_{out} \\ Y_{out} \\ C_{out} \\ M_{out} \end{bmatrix} = \begin{bmatrix} 1 & 0 & 0 \\ 0 & 1 & 0 \\ 0 & 0 & 1 \\ \partial\tau_{GR} & (1-\partial)\tau_{GR} & 0 \\ 0 & (1-\beta)\tau_{GB} & \beta\tau_{GB} \\ (1-\gamma)\tau_{RB} & 0 & \gamma\tau_{RB} \end{bmatrix} \begin{bmatrix} R_{in} \\ G_{in} \\ B_{in} \end{bmatrix}. \tag{12}$$

The conversion matrix T from the three-primary-color input signal for each pixel in the original image to the six-primary-color input signal for the corresponding pixel unit of the N-primary-color display panel may be acquired through equation (12), i.e., $$T = \begin{bmatrix} 1 & 0 & 0 \\ 0 & 1 & 0 \\ 0 & 0 & 1 \\ \partial\tau_{GR} & (1-\partial)\tau_{GR} & 0 \\ 0 & (1-\beta)\tau_{GB} & \beta\tau_{GB} \\ (1-\gamma)\tau_{RB} & 0 & \gamma\tau_{RB} \end{bmatrix}, \text{ where } Y = \begin{bmatrix} R_{out} \\ G_{out} \\ B_{out} \\ Y_{out} \\ C_{out} \\ M_{out} \end{bmatrix}$$

represents the six-primary-color input signal, and $$X = \begin{bmatrix} R_{in} \\ G_{in} \\ B_{in} \end{bmatrix}$$

represents the three-primary-color input signal.

In addition, equation (12) may also be rewritten as Y=TX (13), and through equation (13), it is able to convert the three-primary-color input signal for each pixel in the original image to the six-primary-color input signal for the corresponding pixel unit of the N-primary-color display panel.

Upon the acquisition of the N-primary-color input signal, the N-primary-color input signal may be processed through a pixel rendering algorithm, to acquire an N-primary-color driving signal, and then input the N-primary-color driving signal to the N-primary-color display panel, thereby to display an N-primary-color image. In some possible embodiments of the present disclosure, subsequent to calculating the N-primary-color input signal for the corresponding pixel unit of the N-primary-color display panel in accordance with the color coordinates of each primary color for the N-primary-color display panel and the M-primary-color input signal, the display control method may further include processing the N-primary-color input signal through the pixel rendering algorithm to acquire the N-primary-color driving signal, and inputting the N-primary-color driving signal to the N-primary-color display panel.

Figure 2:
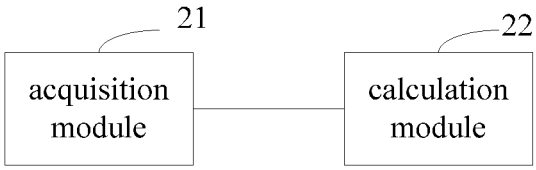
FIG. 2 is a block diagram of a display control device for the N-primary-color display panel according to some embodiments of the present disclosure.

The present disclosure further provides in some embodiments a display control device for an N-primary-color display panel. The N-primary-color display panel includes a plurality of pixel units, and each pixel unit includes subpixels in N primary colors, where N is an integer greater than or equal to 4. As shown in FIG. 2, the display control device includes: an acquisition module 21 configured to acquire an M-primary-color input signal from each pixel in an original image, the original image including a plurality of pixels corresponding to the plurality of pixel units respectively, each pixel being configured to display a colored image in M primary colors, M being an integer greater than 1 and smaller than N; and a calculation module 22 configured to calculate an N-primary-color input signal for a corresponding pixel unit of the N-primary-color display panel in accordance with color coordinates of each primary color for the N-primary-color display panel and the M-primary-color input signal.

According to some embodiments of the present disclosure, the M-primary-color input signal for each pixel in the original image may be acquired, and then the N-primary-color input signal for the corresponding pixel unit of the N-primary-color display panel may be calculated in accordance with the color coordinates of each primary color for the N-primary-color display panel and the M-primary-color input signal, to acquire the four-primary-color, five-primary-color or even six-primary-color input signal in accordance with the three-primary-color input signal. In addition, as compared with a conventional three-primary-color display panel, it is able for the N-primary-color display panel in the embodiments of the present disclosure to display an image in more primary colors, thereby to improve a color gamut of the image as well as a display effect.

Here, the acquisition module 21 and the calculation module 22 may be implemented by a processor. The display control device may further include a data interface and a memory. The data interface may be configured to receive external data, e.g., the M-primary-color input signal for each pixel in the original image. The memory may be configured to store therein the data received via the data interface. The processor may be configured to calculate the N-primary-color input signal for the corresponding pixel unit of the N-primary-color display panel in accordance with the color coordinates of each primary color for the N-primary-color display panel and the M-primary-color input signal for each pixel in the original image. The memory may be further configured to store therein the N-primary-color input signal acquired by the processor.

Figure 3:
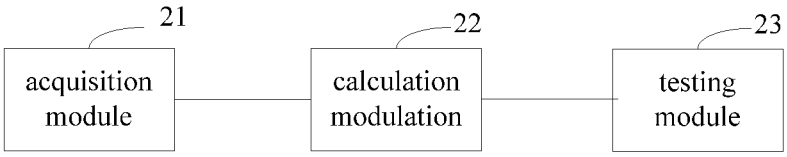
FIG. 3 is another block diagram of the display control device for the N-primary-color display panel according to some embodiments of the present disclosure.

In some possible embodiments of the present disclosure, as shown in FIG. 3, the display control device may further include a testing module 23 configured to test the N-primary-color display panel to acquire the color coordinates of each primary color for the N-primary-color display panel. Color coordinates of each primary color for the N-primary-color display panel depends on a material adopted by the N-primary-color display panel, and the color coordinates of the primary colors for different N-primary-color display panels may be different from each other. Hence, at first, it is necessary to test the N-primary-color display panel, so as to acquire the color coordinates of each primary color for the N-primary-color display panel.

To be specific, the testing module 23 may be optical testing instrument, e.g., a color analyzer. A probe of the color analyzer may be laid on the N-primary-color display panel, and after a measured value is in a stable state, it is able to acquire the color coordinates of each primary color for the N-primary-color display panel.

In some possible embodiments of the present disclosure, the calculation module 22 may be further configured to calculate a conversion matrix from the M-primary-color input signal to the N-primary-color input signal in accordance with the color coordinates of each primary color for the N-primary-color display panel and the M-primary-color input signal, and multiply the M-primary-color input signal with the conversion matrix to acquire the N-primary-color input signal.

The conversion matrix from the three-primary-color input signal to the N-primary-color input signal may be calculated in accordance with the color coordinates of each primary color for the N-primary-color display panel, and upon the receipt of the three-primary-color input signal, the N-primary-color input signal may be acquired through multiplying the three-primary-color input signal with the conversion matrix. In this way, it is able to acquire the four-primary-color, five-primary-color or even the six-primary-color input signal in accordance with the three-primary-color input signal.

In some possible embodiments of the present disclosure, the M primary colors in the M-primary-color input signal may include R, G and B.

In some possible embodiments of the present disclosure, the N primary colors in the N-primary-color input signal include the M primary colors, and at least one primary color X other than the M primary colors, and $X_{out}$ in the N-primary-color input signal for the corresponding pixel unit of the N-primary-color display panel acquired in accordance with the M-primary-color input signal for each pixel in the original image is calculated through the following equation: $X_{out}=\partial\tau_{ij}\times j_{in}+(1-\partial)\tau_{ij}\times i_{in}$ (1). Here, at least one coordinate value of color coordinates of the primary color X in one direction is located between corresponding coordinate values of color coordinates of primary colors i, j in a chromacity diagram, a primary color k is a primary color other than the primary colors i, j in the primary colors R, G and B, $X_{out}$ represents an input signal for the primary color X of the corresponding pixel unit of the N-primary-color display panel, $$\partial = \frac{L_{xi}}{L_{xi} + L_{xj}}, \tag{2}$$

$$\tau_{ii} = \frac{\min(i_{in}, j_{in})}{\max(i_{in}, j_{in})}, \tag{3}$$

$\min(i_{in},j_{in})$ represents a minimum value of grayscale values for i and j in the M-primary-color input signal, $\max(i_{in},j_{in})$ represents a maximum value of the grayscale values for i and j in the M-primary-color input signal, $L_{xi}$ represents a distance between a position corresponding to the color coordinates of x and a position corresponding to the color coordinates of i in the chromacity diagram, and $L_{xj}$ represents a distance between the position corresponding to the color coordinates of x and a position corresponding to the color coordinates of j in the chromacity diagram.

In another possible embodiment of the present disclosure, the N-primary-color display panel may be a five-primary-color display panel, and through the scheme in the embodiments of the present disclosure, it is able to acquire the five-primary-color input signal in accordance with the three-primary-color input signal. To be specific, each pixel unit of the N-primary-color display panel may include an R subpixel, a G subpixel, a B subpixel, a C subpixel and a Y subpixel, and each pixel in the original image may be configured to display the colored image in R, G and B, i.e., the input signal may be an RBG input signal.

In some possible embodiments of the present disclosure, the calculation module 22 may be further configured to calculate the conversion matrix T from a three-primary-color input signal for each pixel in the original image to a five-primary-color input signal for the corresponding pixel unit of the N-primary-color display panel through the following equation:

$$T = \begin{bmatrix} 1 & 0 & 0 \\ 0 & 1 & 0 \\ 0 & 0 & 1 \\ \partial\tau_{GR} & (1-\partial)\tau_{GR} & 0 \\ 0 & (1-\beta)\tau_{GB} & \beta\tau_{GB} \end{bmatrix}, \text{where } \partial = \frac{L_{YG}}{L_{YG}+L_{YR}},$$

$$\beta = \frac{L_{CG}}{L_{CG}+L_{CB}}, \tau_{GR} = \frac{\min(G_{in}, R_{in})}{\max(G_{in}, R_{in})}, \tau_{GB} = \frac{\min(G_{in}, B_{in})}{\max(G_{in}, B_{in})},$$

$\min(G_{in},R_{in})$ represents a minimum value of grayscale values of G and R in the three-primary-color input signal, $\max(G_{in},R_{in})$ represents a maximum value of the grayscale values of G and R in the three-primary-color input signal, $\min(G_{in},B_{in})$ represents a minimum value of grayscale values of G and B in the three-primary-color input signal, $\max(G_{in},B_{in})$ represents a maximum value of the grayscale values of G and B in the three-primary-color input signal, $L_{YR}$ represents a distance between a position corresponding to color coordinates of Y and a position corresponding to color coordinates of R in the chromacity diagram, $L_{YG}$ represents a distance between the position corresponding to the color coordinates of Y and a position corresponding to color coordinates of G in the chromacity diagram, $L_{CG}$ represents a distance between a position corresponding to color coordinates of C and the position corresponding to the color coordinates of G in the chromacity diagram, and $L_{CB}$ represents a distance between the position corresponding to the color coordinates of C and a position corresponding to color coordinates of B in the chromacity diagram.

In some possible embodiments of the present disclosure, the N-primary-color display panel may be a six-primary-color display panel, and through the scheme in the embodiments of the present disclosure, it is able to acquire a six-primary-color input signal in accordance with the three-primary-color input signal. To be specific, each pixel unit of the N-primary-color display panel may include an R subpixel, a G subpixel, a B subpixel, a C subpixel, a Y subpixel, and an M subpixel, and each pixel in the original image may be configured to display the colored image in R, G and B.

In some possible embodiments of the present disclosure, the calculation module 22 may be further configured to calculate the conversion matrix T from a three-primary-color input signal for each pixel in the original image to a six-primary-color input signal for the corresponding pixel unit of the N-primary-color display panel through the following equation:

$$T = \begin{bmatrix} 1 & 0 & 0 \\ 0 & 1 & 0 \\ 0 & 0 & 1 \\ \partial\tau_{GR} & (1-\partial)\tau_{GR} & 0 \\ 0 & (1-\beta)\tau_{GB} & \beta\tau_{GB} \\ (1-\gamma)\tau_{RB} & 0 & \gamma\tau_{RB} \end{bmatrix}, \text{where } \partial = \frac{L_{YG}}{L_{YG}+L_{YR}},$$

$$\beta = \frac{L_{CG}}{L_{CG}+L_{CB}}, \gamma = \frac{L_{MR}}{L_{MB}+L_{MR}} \tau_{GR} = \frac{\min(G_{in}, R_{in})}{\max(G_{in}, R_{in})},$$

$$\tau_{GB} = \frac{\min(G_{in}, B_{in})}{\max(G_{in}, B_{in})}, \tau_{RB} = \frac{\min(G_{in}, B_{in})}{\max(G_{in}, B_{in})}$$

$\min(G_{in},R_{in})$ represents a minimum value of grayscale values of G and R in the three-primary-color input signal, $\max(G_{in},R_{in})$ represents a maximum value of the grayscale values of G and R in the three-primary-color input signal, $\min(G_{in},B_{in})$ represents a minimum value of grayscale values of G and B in the three-primary-color input signal, $\max(G_{in},B_{in})$ represents a maximum value of the grayscale values of G and B in the three-primary-color input signal $\min(G_{in},B_{in})$ represents a minimum value of grayscale values of R and B in the three-primary-color input signal $\max(G_{in},B_{in})$ represents a maximum value of the grayscale values of R and B in the three-primary-color input signal, $L_{YR}$ represents a distance between a position corresponding to color coordinates of Y and a position corresponding to color coordinates of R in the chromacity diagram, $L_{YG}$ represents a distance between the position corresponding to the color coordinates of Y and a position corresponding to color coordinates of G in the chromacity diagram, $L_{CG}$ represents a distance between a position corresponding to color coordinates of C and the position corresponding to the color coordinates of G in the chromacity diagram, $L_{CB}$ represents a distance between the position corresponding to the color coordinates of C and a position corresponding to color coordinates of B in the chromacity diagram, $L_{MR}$ represents a distance between a position corresponding to color coordinates of M and the position corresponding to the color coordinates of R in the chromacity diagram, and $L_{MB}$ represents a distance between the position corresponding to the color coordinates of M and the position corresponding to the color coordinates of B in the chromacity diagram.

Figure 4:
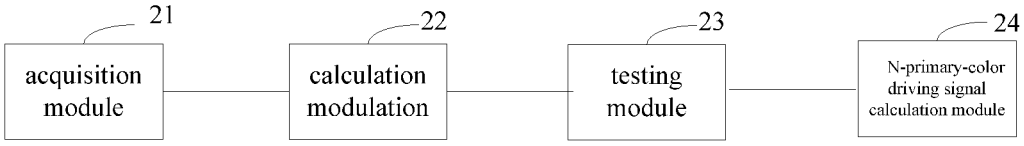
FIG. 4 is yet another block diagram of the display control device for the N-primary-color display panel according to some embodiments of the present disclosure.

In some possible embodiments of the present disclosure, as shown in FIG. 4, the display control device may further include an N-primary-color driving signal calculation module 24 configured to process the N-primary-color input signal through a pixel rendering algorithm to acquire an N-primary-color driving signal, and to input the N-primary-color driving signal to the N-primary-color display panel.

Upon the acquisition of the N-primary-color input signal, the N-primary-color input signal may be processed through the pixel rendering algorithm, to acquire the N-primary-color driving signal, and then input the N-primary-color driving signal to the N-primary-color display panel, thereby to display an N-primary-color image.

The present disclosure further provides in some embodiments a display device including an N-primary-color display panel and the above-mentioned display control device. The display device may be any product or member having a display function, e.g., television, display, digital photo frame, mobile phone or flat-panel computer. The display device may further include a flexible circuit board, a printed circuit board and a back plate.

The present disclosure further provides in some embodiments a display control device for an N-primary-color display panel. The display control device is implemented by a computer, and includes a processor, a memory, and a computer program stored in the memory and executed by the processor so as to implement the above-mentioned display control method.

The present disclosure further provides in some embodiments a computer-readable storage medium storing therein a computer program which is executed by a processor so as to implement the above-mentioned display control method.

It should be further appreciated that, the device and method may be implemented in any other ways. For example, the embodiments for the apparatus are merely for illustrative purposes, and the modules or units are provided merely on the basis of their logic functions. During the actual application, some modules or units may be combined together or integrated into another system. Alternatively, some functions of the module or units may be omitted or not executed. In addition, the coupling connection, direct coupling connection or communication connection between the modules or units may be implemented via interfaces, and the indirect coupling connection or communication connection between the modules or units may be implemented in an electrical or mechanical form or in any other form.

In addition, the functional units in the embodiments of the present disclosure may be integrated into a processing unit, or the functional units may exist independently, or two or more functional units may be combined together. These units may be implemented in the form of hardware, or hardware plus software.

The functional units implemented in a software form may be stored in a computer-readable medium. These software functional units may be stored in a storage medium and include several instructions so as to enable a computer device (a personal computer, a server or network device) to execute all or parts of the steps of the method according to the embodiments of the present disclosure. The storage medium includes any medium capable of storing therein program codes, e.g., a universal serial bus (USB) flash disk, a mobile hard disk (HD), a read-only memory (ROM), a random access memory (RAM), a magnetic disk or an optical disk.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "include" or "including" intends to indicate that an element or object before the word contains an element or object or equivalents thereof listed after the word, without excluding any other element or object. Such words as "connect/connected to" or "couple/coupled to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

It should be appreciated that, in the case that such an element as layer, film, region or substrate is arranged "on" or "under" another element, it may be directly arranged "on" or "under" the other element, or an intermediate element may be arranged therebetween.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A display control method for an N-primary-color display panel, wherein the N-primary-color display panel comprises a plurality of pixel units, and each pixel unit comprises subpixels in N primary colors, where N is an integer greater than or equal to 4, the display control method comprising:

acquiring an M-primary-color input signal from each pixel in an original image, the original image comprising a plurality of pixels corresponding to the plurality of pixel units respectively, each pixel being configured to display a colored image in M primary colors, M being an integer greater than 1 and smaller than N; and calculating an N-primary-color input signal for a corresponding pixel unit of the N-primary-color display panel in accordance with color coordinates of each primary color for the N-primary-color display panel and the M-primary-color input signal, wherein the M primary colors in the M-primary-color input signal comprise red (R), green (G) and blue (B), wherein the N primary colors in the N-primary-color input signal comprise the M primary colors, and at least one primary color X other than the M primary colors, wherein $X_{out}$ in the N-primary-color input signal for the corresponding pixel unit of the N-primary-color display panel acquired in accordance with the M-primary-color input signal for each pixel in the original image is calculated through the following equation: $X_{out}=\partial\tau_{ij}\times j_{in}+(1-\partial)\tau_{ij}\times i_{in}$, where at least one coordinate value of color coordinates of the primary color X in one direction is located between corresponding coordinate values of color coordinates of primary colors i, j in a chromacity diagram, a primary color k is a primary color other than the primary colors i, j in the primary colors R, G and B, $X_{out}$ represents an input signal for the primary color X of the corresponding pixel unit of the N-primary-color display panel, $\tau=$ $$\frac{L_{xi}}{L_{xi}+L_{xj}},\ \tau_{ij}=\frac{\min(i_{in},\ j_{in})}{\max(i_{in},\ j_{in})},$$

min $(i_{in},j_{in})$ represents a minimum value of grayscale values for i and j in the M-primary-color input signal, max $(i_{in},j_{in})$ represents a maximum value of the grayscale values for i and j in the M-primary-color input signal, $L_{xi}$ represents a distance between a position corresponding to the color coordinates of x and a position corresponding to the color coordinates of i in the chromacity diagram, and $L_{xj}$ represents a distance between the position corresponding to the color coordinates of x and a position corresponding to the color coordinates of j in the chromacity diagram.

2. The display control method according to claim 1, wherein the calculating the N-primary-color input signal for the corresponding pixel unit of the N-primary-color display panel in accordance with the color coordinates of each primary color for the N-primary-color display panel and the M-primary-color input signal comprises:

calculating a conversion matrix from the M-primary-color input signal to the N-primary-color input signal in accordance with the color coordinates of each primary color for the N-primary-color display panel and the M-primary-color input signal; and multiplying the M-primary-color input signal with the conversion matrix to acquire the N-primary-color input signal.

3. The display control method according to claim 1, wherein each pixel unit of the N-primary-color display panel comprises an R subpixel, a G subpixel, a B subpixel, a cyan (C) subpixel and a yellow (Y) subpixel, and each pixel in the original image is configured to display the colored image in R, G and B.

4. The display control method according to claim 3, wherein the calculating the conversion matrix from the M-primary-color input signal to the N-primary-color input signal in accordance with the color coordinates of each primary color for the N-primary-color display panel and the M-primary-color input signal comprises calculating the conversion matrix T from a three-primary-color input signal for each pixel in the original image to a five-primary-color input signal for the corresponding pixel unit of the N-primary-color display panel through the following equation:

$$T = \begin{bmatrix} 1 & 0 & 0 \\ 0 & 1 & 0 \\ 0 & 0 & 1 \\ \partial\tau_{GR} & (1-\partial)\tau_{GR} & 0 \\ 0 & (1-\beta)\tau_{GB} & \beta\tau_{GB} \end{bmatrix}, \text{ where } \partial = \frac{L_{YG}}{L_{YG}+L_{YR}},$$

$$\beta = \frac{L_{CG}}{L_{CG}+L_{CB}}, \tau_{GR} = \frac{\min(G_{in}, R_{in})}{\max(G_{in}, R_{in})},$$

$$\tau_{GB} = \frac{\min(G_{in}, B_{in})}{\max(G_{in}, B_{in})}, \min(G_{in}, R_{in})$$

represents a minimum value of grayscale values of G and R in the three-primary-color input signal $\max(G_{in},R_{in})$, represents a maximum value of the grayscale values of G and R in the three-primary-color input signal, $\min(G_{in},B_{in})$ represents a minimum value of grayscale values of G and B in the three-primary-color input signal $\max(G_{in},B_{in})$ represents a maximum value of the grayscale values of G and B in the three-primary-color input signal, $L_{YR}$ represents a distance between a position corresponding to color coordinates of Y and a position corresponding to color coordinates of R in the chromacity diagram, $L_{YG}$ represents a distance between the position corresponding to the color coordinates of Y and a position corresponding to color coordinates of G in the chromacity diagram, $L_{CG}$ represents a distance between a position corresponding to color coordinates of C and the position corresponding to the color coordinates of G in the chromacity diagram, and $L_{CB}$ represents a distance between the position corresponding to the color coordinates of C and a position corresponding to color coordinates of B in the chromacity diagram.

5. The display control method according to claim 1, wherein each pixel unit of the N-primary-color display panel comprises an R subpixel, a G subpixel, a B subpixel, a C subpixel, a Y subpixel, and a magenta (M) subpixel, and each pixel in the original image is configured to display the colored image in R, G and B.

6. The display control method according to claim 5, wherein the calculating the conversion matrix from the M-primary-color input signal to the N-primary-color input signal in accordance with the color coordinates of each primary color for the N-primary-color display panel and the M-primary-color input signal comprises calculating the conversion matrix T from a three-primary-color input signal for each pixel in the original image to a six-primary-color input signal for the corresponding pixel unit of the N-primary-color display panel through the following equation:

$$T = \begin{bmatrix} 1 & 0 & 0 \\ 0 & 1 & 0 \\ 0 & 0 & 1 \\ \partial\tau_{GR} & (1-\partial)\tau_{GR} & 0 \\ 0 & (1-\beta)\tau_{GB} & \beta\tau_{GB} \\ (1-\gamma)\tau_{RB} & 0 & \gamma\tau_{RB} \end{bmatrix}, \text{ where } \partial = \frac{L_{YG}}{L_{YG}+L_{YR}},$$

$$\beta = \frac{L_{CG}}{L_{CG}+L_{CB}}, \gamma = \frac{L_{MR}}{L_{MB}+L_{MR}}\tau_{GR} = \frac{\min(G_{in}, R_{in})}{\max(G_{in}, R_{in})},$$

$$\tau_{GB} = \frac{\min(G_{in}, B_{in})}{\max(G_{in}, B_{in})}, \tau_{RB} = \frac{\min(G_{in}, B_{in})}{\max(G_{in}, B_{in})}, \min(G_{in}, R_{in})$$

represents a minimum value of grayscale values of G and R in the three-primary-color input signal, $\max(G_{in},R_{in})$ represents a maximum value of the grayscale values of G and R in the three-primary-color input signal, $\min(G_{in},B_{in})$ represents a minimum value of grayscale values of G and B in the three-primary-color input signal, $\max(G_{in},B_{in})$ represents a maximum value of the grayscale values of G and B in the three-primary-color input signal $\min(R_{in}, B_{in})$ represents a minimum value of grayscale values of R and B in the three-primary-color input signal, $\max(R_{in},B_{in})$ represents a maximum value of the grayscale values of R and B in the three-primary-color input signal, $L_{YR}$ represents a distance between a position corresponding to color coordinates of Y and a position corresponding to color coordinates of R in the chromacity diagram, $L_{YG}$ represents a distance between the position corresponding to the color coordinates of Y and a position corresponding to color coordinates of G in the chromacity diagram, $L_{CG}$ represents a distance between a position corresponding to color coordinates of C and the position corresponding to the color coordinates of G in the chromacity diagram, $L_{CB}$ represents a distance between the position corresponding to the color coordinates of C and a position corresponding to color coordinates of B in the chromacity diagram, $L_{MR}$ represents a distance between a position corresponding to color coordinates of M and the position corresponding to the color coordinates of R in the chromacity diagram, and $L_{MB}$ represents a distance between the position corresponding to the color coordinates of M and the position corresponding to the color coordinates of B in the chromacity diagram.

7. The display control method according to claim 1, wherein prior to the calculating the N-primary-color input signal for the corresponding pixel unit of the N-primary-color display panel in accordance with the color coordinates of each primary color for the N-primary-color display panel and the M-primary-color input signal, the display control method further comprises testing the N-primary-color display panel to acquire the color coordinates of each primary color for the N-primary-color display panel.

8. The display control method according to claim 1, wherein subsequent to calculating the N-primary-color input signal for the corresponding pixel unit of the N-primary-color display panel in accordance with the color coordinates of each primary color for the N-primary-color display panel and the M-primary-color input signal, the display control method further comprises processing the N-primary-color input signal through a pixel rendering algorithm to acquire an N-primary-color driving signal, and inputting the N-primary-color driving signal to the N-primary-color display panel.

9. A display control device for an N-primary-color display panel implemented by a computer, comprising a processor, a memory, and computer programs stored in the memory and executed by the processor to implement a display control method for the N-primary-color display panel, wherein the N-primary-color display panel comprises a plurality of pixel units, and each pixel unit comprises subpixels in N primary colors, where N is an integer greater than or equal to 4;

wherein the processor is configured to execute the computer programs, and configured to implement the method according to claim 1.

10. The display control device according to claim 9, wherein the processor is further configured to execute the computer programs, and configured to: calculate a conversion matrix from the M-primary-color input signal to the N-primary-color input signal in accordance with the color coordinates of each primary color for the N-primary-color display panel and the M-primary-color input signal; and multiply the M-primary-color input signal with the conversion matrix to acquire the N-primary-color input signal.

11. The display control device according to claim 9, wherein each pixel unit of the N-primary-color display panel comprises an R subpixel, a G subpixel, a B subpixel, a C subpixel and a Y subpixel, and each pixel in the original image is configured to display the colored image in R, G and B.

12. The display control device according to claim 11, wherein the processor is further configured to execute the computer program, so as to calculate the conversion matrix T from a three-primary-color input signal for each pixel in the original image to a five-primary-color input signal for the corresponding pixel unit of the N-primary-color display panel through the following equation:

$$T = \begin{bmatrix} 1 & 0 & 0 \\ 0 & 1 & 0 \\ 0 & 0 & 1 \\ \partial\tau_{GR} & (1-\partial)\tau_{GR} & 0 \\ 0 & (1-\beta)\tau_{GB} & \beta\tau_{GB} \\ (1-\gamma)\tau_{RB} & 0 & \gamma\tau_{RB} \end{bmatrix}, \text{ where } \partial = \frac{L_{YG}}{L_{YG}+L_{YR}},$$

$$\beta = \frac{L_{CG}}{L_{CG}+L_{CB}}, \gamma = \frac{L_{MR}}{L_{MB}+L_{MR}}\tau_{GR} = \frac{\min(G_{in}, R_{in})}{\max(G_{in}, R_{in})},$$

$$\tau_{GB} = \frac{\min(G_{in}, B_{in})}{\max(G_{in}, B_{in})}, \tau_{RB} = \frac{\min(G_{in}, B_{in})}{\max(G_{in}, B_{in})}, \min(G_{in}, R_{in})$$

represents a minimum value of grayscale values of G and R in the three-primary-color input signal, $\max(G_{in},R_{in})$ represents a maximum value of the grayscale values of G and R in the three-primary-color input signal $\min(G_{in},B_{in})$ represents a minimum value of grayscale values of G and B in the three-primary-color input signal $\max(G_{in},B_{in})$ represents a maximum value of the grayscale values of G and B in the three-primary-color input signal, $L_{YR}$ represents a distance between a position corresponding to color coordinates of Y and a position corresponding to color coordinates of R in the chromacity diagram, $L_{YG}$ represents a distance between the position corresponding to the color coordinates of Y and a position corresponding to color coordinates of G in the chromacity diagram, $L_{CG}$ represents a distance between a position corresponding to color coordinates of C and the position corresponding to the color coordinates of G in the chromacity diagram, and $L_{CB}$ represents a distance between the position corresponding to the color coordinates of C and a position corresponding to color coordinates of B in the chromacity diagram.

13. The display control device according to claim 9, wherein each pixel unit of the N-primary-color display panel comprises an R subpixel, a G subpixel, a B subpixel, a C subpixel, a Y subpixel, and an M subpixel, and each pixel in the original image is configured to display the colored image in R, G and B.

14. The display control device according to claim 13, wherein the processor is further configured to execute the computer program, and configured to calculate the conversion matrix T from a three-primary-color input signal for each pixel in the original image to a six-primary-color input signal for the corresponding pixel unit of the N-primary-color display panel through the following equation:

$$T = \begin{bmatrix} 1 & 0 & 0 \\ 0 & 1 & 0 \\ 0 & 0 & 1 \\ \partial\tau_{GR} & (1-\partial)\tau_{GR} & 0 \\ 0 & (1-\beta)\tau_{GB} & \beta\tau_{GB} \\ (1-\gamma)\tau_{RB} & 0 & \gamma\tau_{RB} \end{bmatrix}, \text{ where } \partial = \frac{L_{YG}}{L_{YG}+L_{YR}},$$

$$\beta = \frac{L_{CG}}{L_{CG}+L_{CB}}, \gamma = \frac{L_{MR}}{L_{MB}+L_{MR}}\tau_{GR} = \frac{\min(G_{in}, R_{in})}{\max(G_{in}, R_{in})},$$

$$\tau_{GB} = \frac{\min(G_{in}, B_{in})}{\max(G_{in}, B_{in})}, \tau_{RB} = \frac{\min(G_{in}, B_{in})}{\max(G_{in}, B_{in})}, \min(G_{in}, R_{in})$$

represents a minimum value of grayscale values of G and R in the three-primary-color input signal, $\max(G_{in},R_{in})$ represents a maximum value of the grayscale values of G and R in the three-primary-color input signal $\min(G_{in},B_{in})$ represents a minimum value of grayscale values of G and B in the three-primary-color input signal, $\max(G_{in},B_{in})$ represents a maximum value of the grayscale values of G and B in the three-primary-color input signal $\min(R_{in},B_{in})$ represents a minimum value of grayscale values of R and B in the three-primary-color input signal $\max(R_{in},B_{in})$ represents a maximum value of the grayscale values of R and B in the three-primary-color input signal, $L_{YR}$ represents a distance between a position corresponding to color coordinates of Y and a position corresponding to color coordinates of R in the chromacity diagram, $L_{YG}$ represents a distance between the position corresponding to the color coordinates of Y and a position corresponding to color coordinates of G in the chromacity diagram, $L_{CG}$ represents a distance between a position corresponding to color coordinates of C and the position corresponding to the color coordinates of G in the chromacity diagram, $L_{CB}$ represents a distance between the position corresponding to the color coordinates of C and a position corresponding to color coordinates of B in the chromacity diagram, $L_{MR}$ represents a distance between a position corresponding to color coordinates of M and the position corresponding to the color coordinates of R in the chromacity diagram, and $L_{MB}$ represents a distance between the position corresponding to the color coordinates of M and the position corresponding to the color coordinates of B in the chromacity diagram.

15. The display control device according to claim 9, wherein the processor is further configured to execute the computer programs, and configured to process the N-primary-color input signal through a pixel rendering algorithm to acquire an N-primary-color driving signal, and to input the N-primary-color driving signal to the N-primary-color display panel.

16. A display device, comprising an N-primary-color display panel and the display control device according to claim 9.

17. A display control method for an N-primary-color display panel, wherein the N-primary-color display panel comprises a plurality of pixel units, and each pixel unit comprises subpixels in N primary colors, where N is an integer greater than or equal to 4, the display control method comprising:

acquiring an M-primary-color input signal from each pixel in an original image, the original image comprising a plurality of pixels corresponding to the plurality of pixel units respectively, each pixel being configured to display a colored image in M primary colors, M being an integer greater than 1 and smaller than N; and calculating an N-primary-color input signal for a corresponding pixel unit of the N-primary-color display panel in accordance with color coordinates of each primary color for the N-primary-color display panel and the M-primary-color input signal, wherein the M primary colors in the M-primary-color input signal comprise red (R), green (G) and blue (B), wherein each pixel unit of the N-primary-color display panel comprises an R subpixel, a G subpixel, a B subpixel, a cyan (C) subpixel and a yellow (Y) subpixel, and each pixel in the original image is configured to display the colored image in R, G and B, wherein the calculating the conversion matrix from the M-primary-color input signal to the N-primary-color input signal in accordance with the color coordinates of each primary color for the N-primary-color display panel and the M-primary-color input signal comprises calculating the conversion matrix T from a three-primary-color input signal for each pixel in the original image to a five-primary-color input signal for the corresponding pixel unit of the N-primary-color display panel through the following equation:

$$T = \begin{bmatrix} 1 & 0 & 0 \\ 0 & 1 & 0 \\ 0 & 0 & 1 \\ \partial\tau_{GR} & (1-\partial)\tau_{GR} & 0 \\ 0 & (1-\beta)\tau_{GB} & \beta\tau_{GB} \end{bmatrix}, \text{ where } \partial = \frac{L_{YG}}{L_{YG}+L_{YR}},$$

$$\beta = \frac{L_{CG}}{L_{CG}+L_{CB}}, \tau_{GR} = \frac{\min(G_{in}, R_{in})}{\max(G_{in}, R_{in})},$$

$$\tau_{GB} = \frac{\min(G_{in}, B_{in})}{\max(G_{in}, B_{in})}, \min(G_{in}, R_{in})$$

represents a minimum value of grayscale values of G and R in the three-primary-color input signal, $\max(G_{in},R_{in})$ represents a maximum value of the grayscale values of G and R in the three-primary-color input signal $\min(G_{in},B_{in})$ represents a minimum value of grayscale values of G and B in the three-primary-color input signal $\max(G_{in},B_{in})$ represents a maximum value of the grayscale values of G and B in the three-primary-color input signal, $L_{YR}$ represents a distance between a position corresponding to color coordinates of Y and a position corresponding to color coordinates of R in the chromacity diagram, $L_{YG}$ represents a distance between the position corresponding to the color coordinates of Y and a position corresponding to color coordinates of G in the chromacity diagram, $L_{CG}$ represents a distance between a position corresponding to color coordinates of C and the position corresponding to the color coordinates of G in the chromacity diagram, and $L_{CB}$ represents a distance between the position corresponding to the color coordinates of C and a position corresponding to color coordinates of B in the chromacity diagram.

18. A display control method for an N-primary-color display panel, wherein the N-primary-color display panel comprises a plurality of pixel units, and each pixel unit comprises subpixels in N primary colors, where N is an integer greater than or equal to 4, the display control method comprising:

acquiring an M-primary-color input signal from each pixel in an original image, the original image comprising a plurality of pixels corresponding to the plurality of pixel units respectively, each pixel being configured to display a colored image in M primary colors, M being an integer greater than 1 and smaller than N; and calculating an N-primary-color input signal for a corresponding pixel unit of the N-primary-color display panel in accordance with color coordinates of each primary color for the N-primary-color display panel and the M-primary-color input signal, wherein the M primary colors in the M-primary-color input signal comprise red (R), green (G) and blue (B), wherein each pixel unit of the N-primary-color display panel comprises an R subpixel, a G subpixel, a B subpixel, a C subpixel, a Y subpixel, and a magenta (M) subpixel, and each pixel in the original image is configured to display the colored image in R, G and B, wherein the calculating the conversion matrix from the M-primary-color input signal to the N-primary-color input signal in accordance with the color coordinates of each primary color for the N-primary-color display panel and the M-primary-color input signal comprises calculating the conversion matrix T from a three-primary-color input signal for each pixel in the original image to a six-primary-color input signal for the corresponding pixel unit of the N-primary-color di splay panel through the following equation:

$$\partial = \frac{L_{xi}}{L_{xi}+L_{xj}}, \tau_{ij} = \frac{\min(i_{in}, j_{in})}{\max(i_{in}, j_{in})},$$

represents a minimum value of grayscale values of G and R in the three-primary-color input signal, $\max(G_{in},R_{in})$ represents a maximum value of the grayscale values of G and R in the three-primary-color input signal $\min(G_{in},B_{in})$ represents a minimum value of grayscale values of G and B in the three-primary-color input signal $\max(G_{in},B_{in})$ represents a maximum value of the grayscale values of G and B in the three-primary-color input signal $\min(R_{in},B_{in})$ represents a minimum value of grayscale values of R and B in the three-primary-color input signal, $\max(R_{in},B_{in})$ represents a maximum value of the grayscale values of R and B in the three-primary-color input signal, $L_{YR}$ represents a distance between a position corresponding to color coordinates of Y and a position corresponding to color coordinates of R in the chromacity diagram, $L_{YG}$ represents a distance between the position corresponding to the color coordinates of Y and a position corresponding to color coordinates of G in the chromacity diagram, $L_{CG}$ represents a distance between a position corresponding to color coordinates of C and the position corresponding to the color coordinates of G in the chromacity diagram, $L_{CB}$ represents a distance between the position corresponding to the color coordinates of C and a position corresponding to color coordinates of B in the chromacity diagram, $L_{MR}$ represents a distance between a position corresponding to color coordinates of M and the position corresponding to the color coordinates of R in the chromacity diagram, and $L_{MB}$ represents a distance between the position corresponding to the color coordinates of M and the position corresponding to the color coordinates of B in the chromacity diagram.

* * * * *